US010099265B2

(12) United States Patent
Oakner et al.

(10) Patent No.: US 10,099,265 B2
(45) Date of Patent: Oct. 16, 2018

(54) FOOT OPERATED DRAIN PUMP

(71) Applicant: MSD Research, Inc., Boca Raton, FL (US)

(72) Inventors: Stuart Oakner, Boca Raton, FL (US); Donna Oakner, Boca Raton, FL (US)

(73) Assignee: MSD Research, Inc., Boca Raton, FL (US)

( * ) Notice: Subject to any disclaimer, the term of this patent is extended or adjusted under 35 U.S.C. 154(b) by 21 days.

(21) Appl. No.: 15/440,846

(22) Filed: Feb. 23, 2017

(65) Prior Publication Data

US 2017/0239697 A1 Aug. 24, 2017

Related U.S. Application Data

(60) Provisional application No. 62/298,564, filed on Feb. 23, 2016.

(51) Int. Cl.

| | |
|---|---|
| ***B08B 9/032*** | (2006.01) |
| ***F24F 13/22*** | (2006.01) |
| ***B08B 9/035*** | (2006.01) |
| ***E03C 1/308*** | (2006.01) |

(52) U.S. Cl.

CPC ..... *B08B 9/0328* (2013.01); *B08B 9/035* (2013.01); *B08B 9/0326* (2013.01); *E03C 1/308* (2013.01); *F24F 13/222* (2013.01); *B08B 2209/032* (2013.01); *F24F 2013/227* (2013.01); *F24F 2221/22* (2013.01); *F24F 2221/225* (2013.01)

(58) Field of Classification Search

CPC ..... B08B 9/0328; B08B 9/0326; B08B 9/035; E03C 1/308; F24F 13/222; F24F 2013/227; F24F 2221/22; F24F 2221/225

See application file for complete search history.

(56) References Cited

U.S. PATENT DOCUMENTS

| | | | | |
|---|---|---|---|---|
| 3,046,591 | A * | 7/1962 | Prohaska | B60S 1/482 15/250.02 |
| 4,539,985 | A | 9/1985 | Magrath | |
| 4,951,329 | A | 8/1990 | Shaw | |
| 6,067,668 | A * | 5/2000 | Rudd | E03C 1/308 4/255.01 |
| 6,405,385 | B1 * | 6/2002 | Smith | E03C 1/308 4/255.01 |
| 2004/0200514 | A1 | 10/2004 | Lee | |

* cited by examiner

*Primary Examiner* — Dung Van Nguyen
(74) *Attorney, Agent, or Firm* — Robert M. Downey, PA

(57) ABSTRACT

A foot operated pump includes a water and airtight flexible and collapsible wall between a top plate and a base plate and an interior variable volume chamber. A flexible hose is selectively attachable to either an inlet port or an outlet port on the top plate member. The contents (air and/or liquid) within the variable volume chamber are forced out of the outlet port upon forced downward movement of the top plate member towards the base plate member. As the top plate member returns to a normally relaxed state in separated, angled relation to the base plate, the variable volume chamber enlarges and air is sucked through the inlet port to fill the variable volume chamber. An opposite end of the flexible hose attaches to various adapters and fittings for clearing clogged drain lines and other conduits.

20 Claims, 5 Drawing Sheets

FOOT OPERATED DRAIN PUMP

This non-provisional patent application is based on provisional patent application Ser. No. 62/298,564 filed Feb. 23, 2016.

BACKGROUND OF THE INVENTION

Discussion of the Related Art

Clearing a drain line, such as a condensate drain line in an HVAC system, is usually accomplished with the use of a vacuum, garden hose or a compressed nitrogen gas tank, wherein a hose with a plug or other fitting is held within an open port of the drain line to apply either a suction force or pressurized flow of gas or water within the drain line which removes material that is obstructing flow of liquid through the line. The presently used methods of clearing a drain line, particularly in an HVAC system, can be problematic to both the service technician as well as the homeowner. For instance, use of pressurized water flow from a garden hose can be messy and requires the hose to be dragged into the house for attachment to an open drain line port near the HVAC unit. Alternatively, use of equipment such as a wet/dry vacuum or compressed nitrogen tank requires the service technician to carry this equipment into the home, often up a flight of stairs, to the location of the HVAC unit. In all instances, the service technician is required to maintain their grasp on the hose that extends from the suction or pressurized source (spigot, vacuum or compressed gas tank) to the drain line port, thereby requiring the use of at least one hand, and in many instances both hands. Accordingly, it can be appreciated that the need to lug a garden hose or costly and cumbersome equipment into the house can be inconvenient, messy and somewhat costly to the service company.

For the reasons set forth above, there remains a definite need for a lightweight, relatively inexpensive and compact device for clearing clogs in drain lines, toilets and other conduits in a home or building and wherein the device is easy to operate with the use of just one foot, thereby allowing the service technician to have full use of their hands for simultaneously performing other tasks.

OBJECTS AND ADVANTAGES OF THE INVENTION

Considering the forgoing, it is a primary object of the present invention to provide a foot powered pump for clearing clogs in drain lines (e.g., HVAC condensate drain lines), sink drains, toilets and other conduits with hands-free operation.

It is a further object of the present invention to provide a foot powered pump with a flexible hose, and wherein the foot powered pump is adapted to selectively direct a pressurized flow of air and/or liquid through the hose or, alternatively, to apply a suction force through the hose, wherein the hose is attachable to a HVAC drain line, sink drain, toilet or other conduits for clearing a clog.

It is still a further object of the present invention to provide a foot operated bellows pump that is watertight and which includes both a suction inlet port and a blow-out outlet port for selective connection of a flexible hose thereto, and wherein the opposite end of the flexible hose can be attached to various fittings for connection to an HVAC ¾ inch PVC drain line, sink drain or toilet in order to clear clogs.

It is still a further object of the present invention to provide a foot operated, watertight bellows pump for clearing clogs in HVAC drain lines, sink drains and toilets, and wherein the foot operated watertight bellows pump is lightweight, relatively compact, and inexpensive.

It is still a further object of the present invention to provide a foot operated, watertight bellows pump that includes an interior variable volume collapsible chamber and a drain plug to allow the interior variable volume chamber to be flushed out and cleaned, as well as to allow the interior variable volume chamber to be filled with water through the drain plug port to thereby allow the foot operated bellows pump to force a flow of water through a drain line, sink drain, toilet or other conduit for purposes of clearing a clog.

It is still a further object of the present invention to provide a foot operated, watertight bellows pump that allows for hands-free operation, and wherein a flexible hose is adapted to be removably interlocked to either an inlet port or outlet port on the bellows pump, and further wherein an opposite end of the flexible hose can be fitted with any of the various adapters for attachment to an HVAC condensate drain line, sink drain, toilet or inflation nozzle to inflate an air mattress or raft.

These and other objects and advantages of the present invention are more readily apparent with reference to the following detailed description taken in conjunction with the accompanying drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Referring to the several views of the drawings, the present invention is directed to a foot operated drain pump assembly, generally indicated as 10, including a watertight bellows pump 12 and a flexible hose 20 having a distal end 22 that is structured for attachment to various adapters and/or fittings to allow connection of the flexible hose 20 to HVAC condensate drain lines, sink drains, toilets and other conduits for the purpose of clearing a clog.

Figure 1:
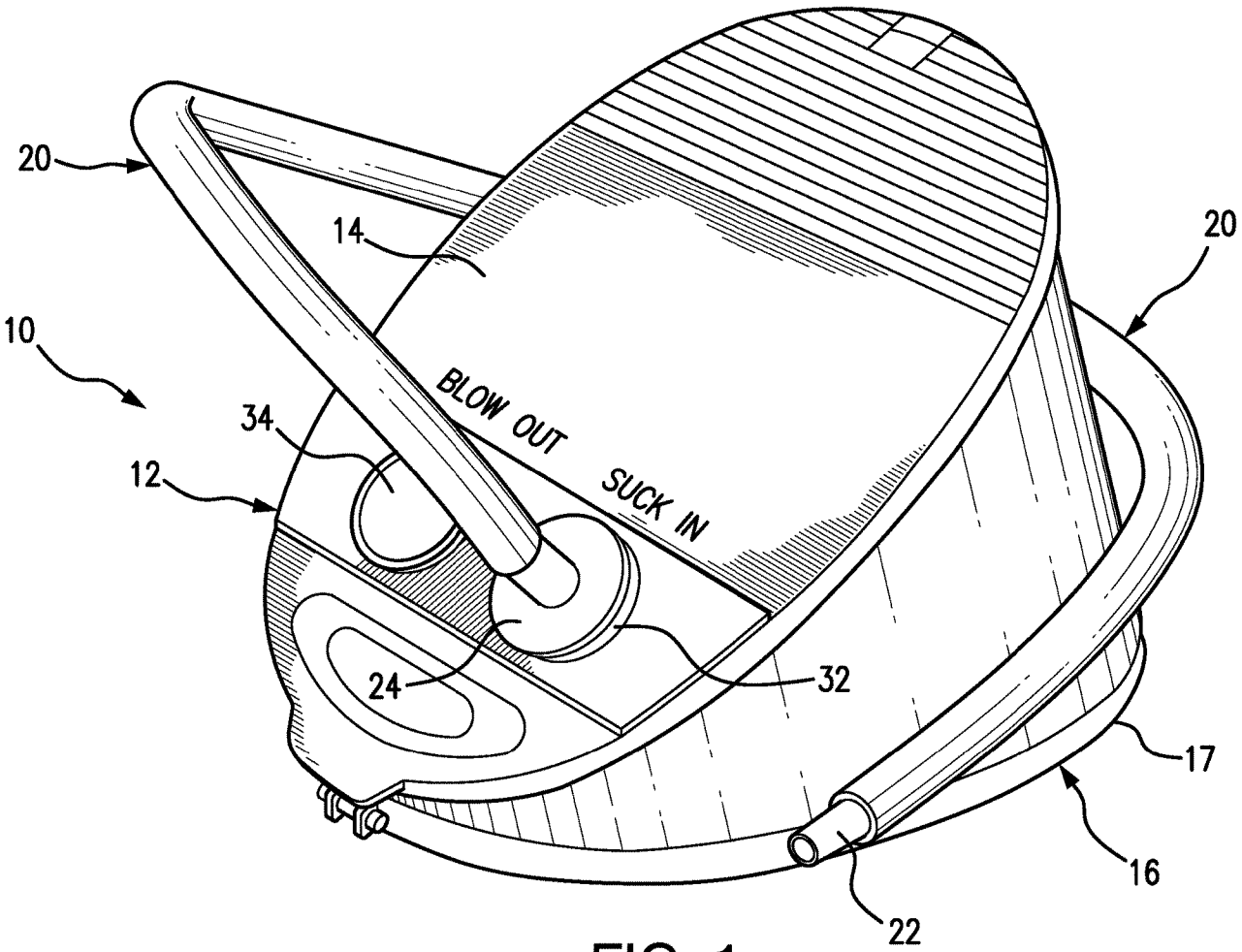
FIG. 1 is a top perspective view of the foot operated, watertight bellows pump in accordance with a preferred embodiment of the present invention, and wherein the bellows pump includes both a "blow-out" port and a "suction" port, and wherein a flexible hose is shown in releasable, interlocked connection to the "suction" port.
Figure 2:
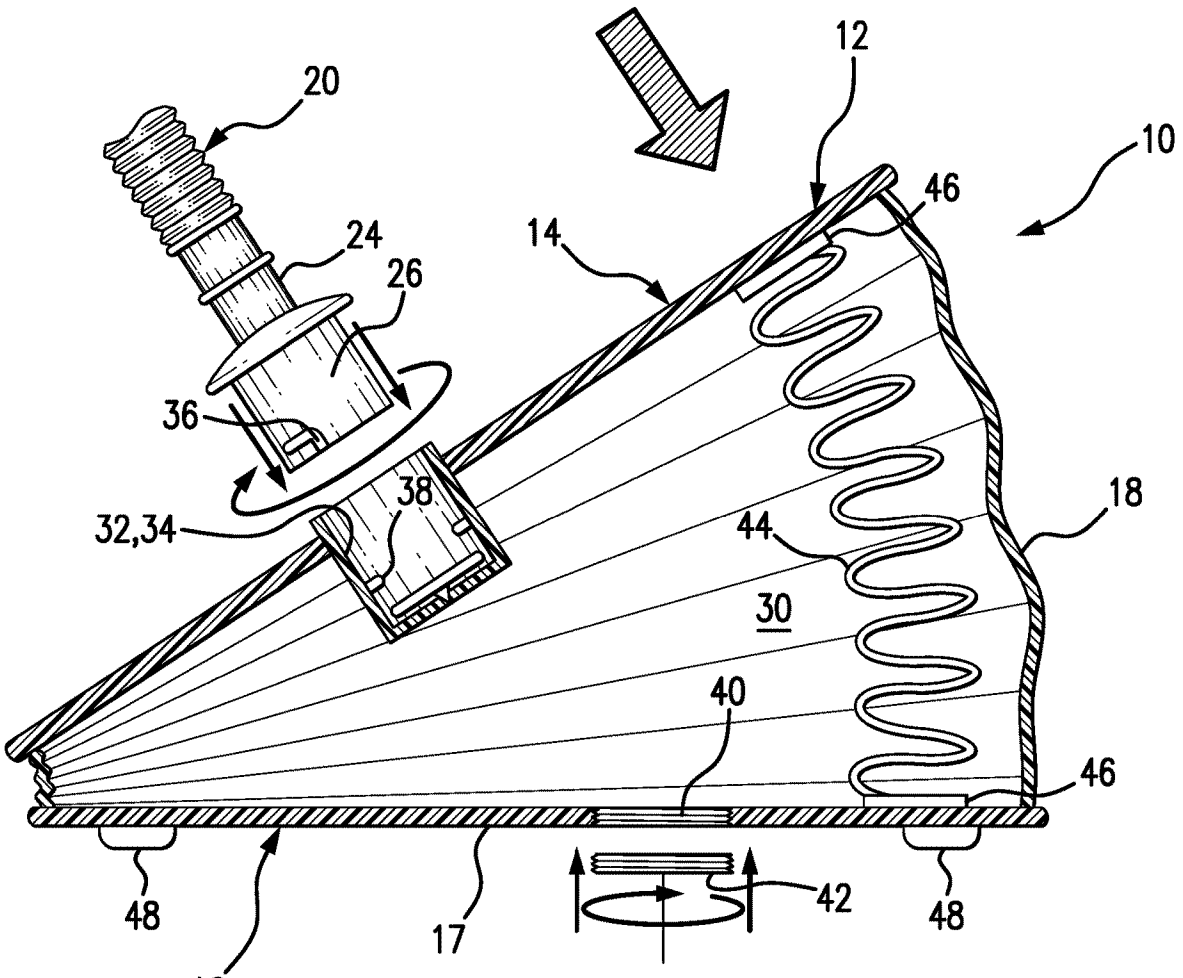
FIG. 2 is a cross-sectional view of the bellows pump showing connection of an end of the flexible hose to one of either the "blow-out" or "suction" ports and further illustrating a removable drain plug on the bottom of the bellows pump.

The foot operated bellows pump 12 includes a top plate member 14, a base plate member 16 and an airtight and watertight flexible and collapsible wall 18 extending between the top plate member 14 and the base plate member 16, in watertight, sealed attachment therewith. In a relaxed state, the top plate member 14 is positioned at an angled relation and separated from the base plate member 16. An interior variable volume chamber 30 has a maximum volume when the bellows pump is in the relaxed state and the top plate member 14 is angled upwardly as seen in FIGS. 1 and 2. In one embodiment, at least one spring element 44 (e.g., a coil spring) is provided within the interior chamber 30 for urging the top plate member to the relaxed state. Holding structures 46 may be provided on the inner facing sides of the top plate member 14 and base plate member 16 for securing the opposite ends of the spring element 44. The top plate member 14 includes both an inlet, defining a suction port 32, and an outlet, defining a blow-out port 34. Both the suction port 32 and blow-out port 34 are fitted with check valve members, such as flap valves or diaphragm flapper valves. When the contents (air and/or liquid) within the chamber 30 are forced out, the check valve in the outlet port 34 opens and allows for outward passage of the contents while, simultaneously, the check valve in the inlet port remains closed and prevents air from entering the chamber 30. When a downward force is applied to the top plate member 14, the top plate member 14 is moved towards the base plate member 16 as the flexible wall 18 collapses and the volume of the variable volume chamber 30 is rapidly reduced. This causes the contents (air and/or liquid) in the chamber 30 to be forced out through the outlet port 34 and through the hose 20 if connected thereto, as the check valve in the outlet port opens. Upon removing the downward force on the top plate member 14, the top plate member 14 returns to the normally relaxed state in separated, angled relation to the base plate member 16. As the top plate member 14 returns to the relaxed state, the volume of the variable volume chamber 30 increases and air is sucked through the inlet (suction) port 32 (as well as the hose 20 if connected to the inlet port 32), while the check valve in the inlet port opens, to fill the variable volume chamber 30. The check valve in the outlet port remains closed as air is sucked through the inlet port 32.

As seen in FIG. 2, a proximal end 24 of the flexible hose 20 includes a fitting 26 that is adapted for interlocking engagement within both the suction port 32 and blow-out port 34. More specifically, the fitting 26 on the proximal end 24 of the flexible hose 20 is selectively inserted within either the suction port 32 or blow-out port 34 and then, once fully received, the fitting 26 is turned through a partial rotation causing the fitting 26 to be releasably interlocked within the port (32 or 34). This can be achieved with a groove or channel 36 on the fitting 26 of the hose 20 or within the port, and a corresponding nub 38 on the other of either the hose fitting 26 or within the port, such that the nub 38 is received within the groove 36 and upon a twisting force to the fitting, the nub 38 releasably interlocks within the groove 36 to secure the hose fitting 26 within the port (32 or 34).

Referring to FIG. 2, the base plate member 16 is provided with a drain port 40 and drain plug 42. The drain plug 42 normally closes the drain port 40 and can be removed to allow emptying of liquid contents from within the variable volume interior chamber 30 out through the drain port 42. This also allows the interior chamber 30 to be flushed out and cleaned. Alternatively, the drain plug 42 can be removed to allow the interior chamber 30 to be filled with water for subsequent discharge from the blow-out port 34 upon operation of the bellows pump 12. In this instance, the interior chamber 30 would be filled with water and the drain plug 42 replaced. Thereafter, upon applying a downward force on the top plate member 14, using one's foot, the water content within the interior chamber 30 is forced out through the blow-out port 34. With the flexible hose 20 connected to the blow-out port 34, the forced flow of water can be directed into a drain line (e.g., an HVAC condensate drain line or sink drain) or toilet in order to forcefully flush out a clog. Alternatively, with the flexible hose 20 connected to the suction port 32, release of the top plate member 14 from the fully collapsed position allows the top plate member 14 to rise and expand the volume of the interior chamber 30 which creates a suction through the hose 20 that, when connected to a drain line can pull a clog and fluid out of the drain line and through the flexible hose 20 and into the variable volume chamber 30 of the bellows pump 12.

Figure 3:
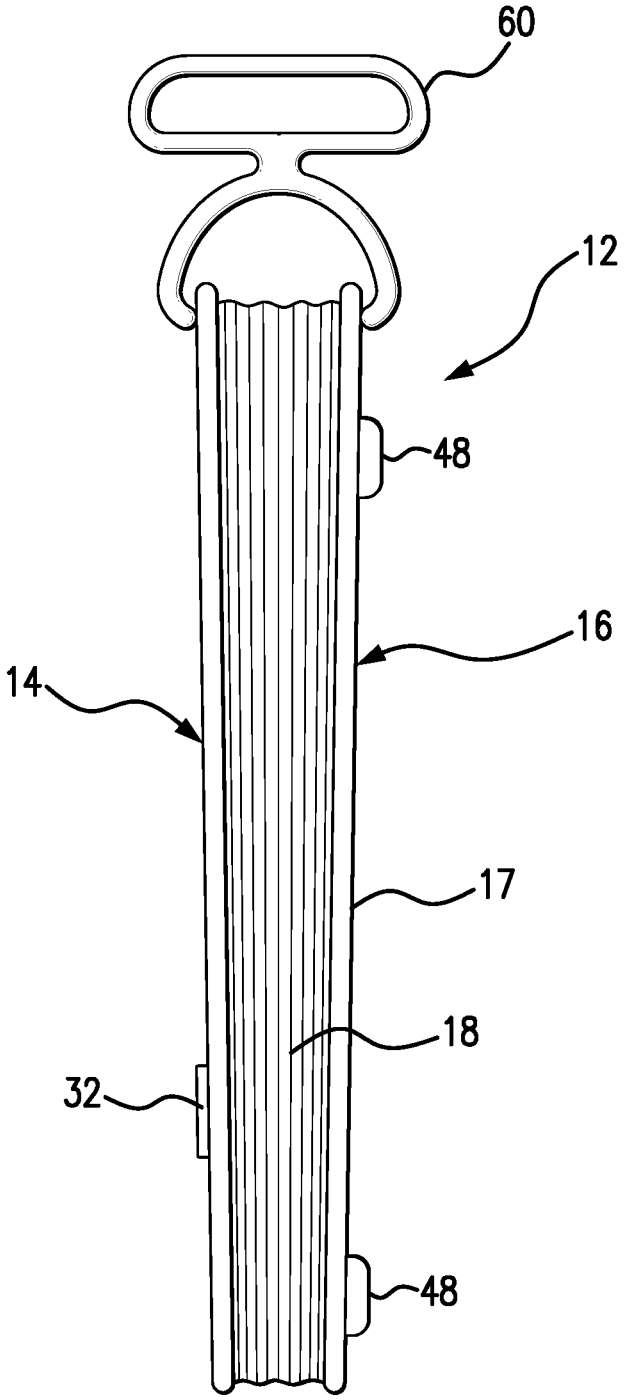
FIG. 3 is a side elevational view showing the bellows pump in a collapsed state with a handle clip connected to an end of the bellows pump to hold the bellows pump in the collapsed state for purposes of transport and storage.

The bottom surface 17 of the base plate member 16 is provided with a rubber, slip resistant material allowing the base plate member to grip a floor surface upon foot operation of the bellows pump 12. In one embodiment, rubber or like material feet 48 are attached to the outside bottom surface 17 of the base plate member 16 to provide grip on the underlying floor surface. The bellows pump 12 can be held in the low profile collapsed state with a clip and handle device 60, as shown in FIG. 3, to allow for convenient carrying and storage.

Figure 4:
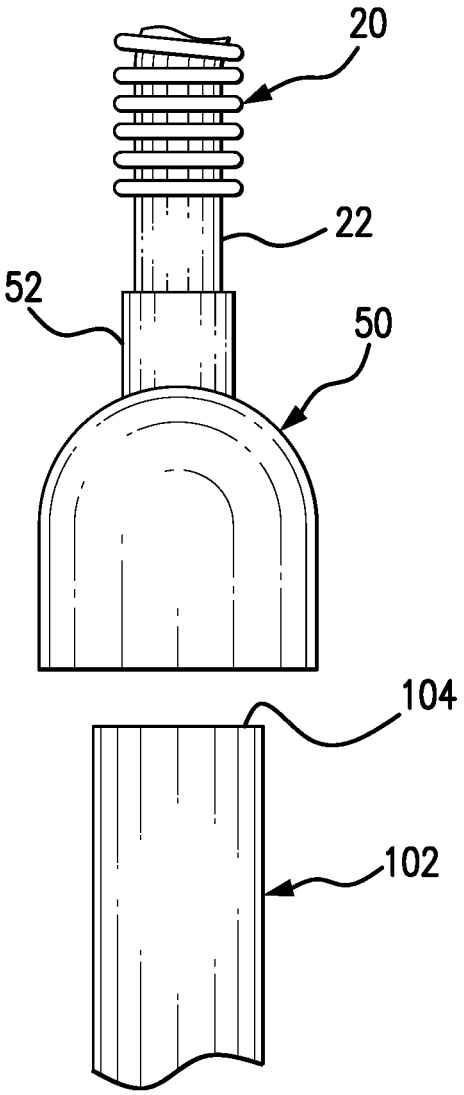
FIG. 4 is an isolated elevational view showing a distal end of a flexible hose of the present invention connected to an adapter to be fitted over the open end of a ¾ inch PVC drain line extension.
Figure 5:
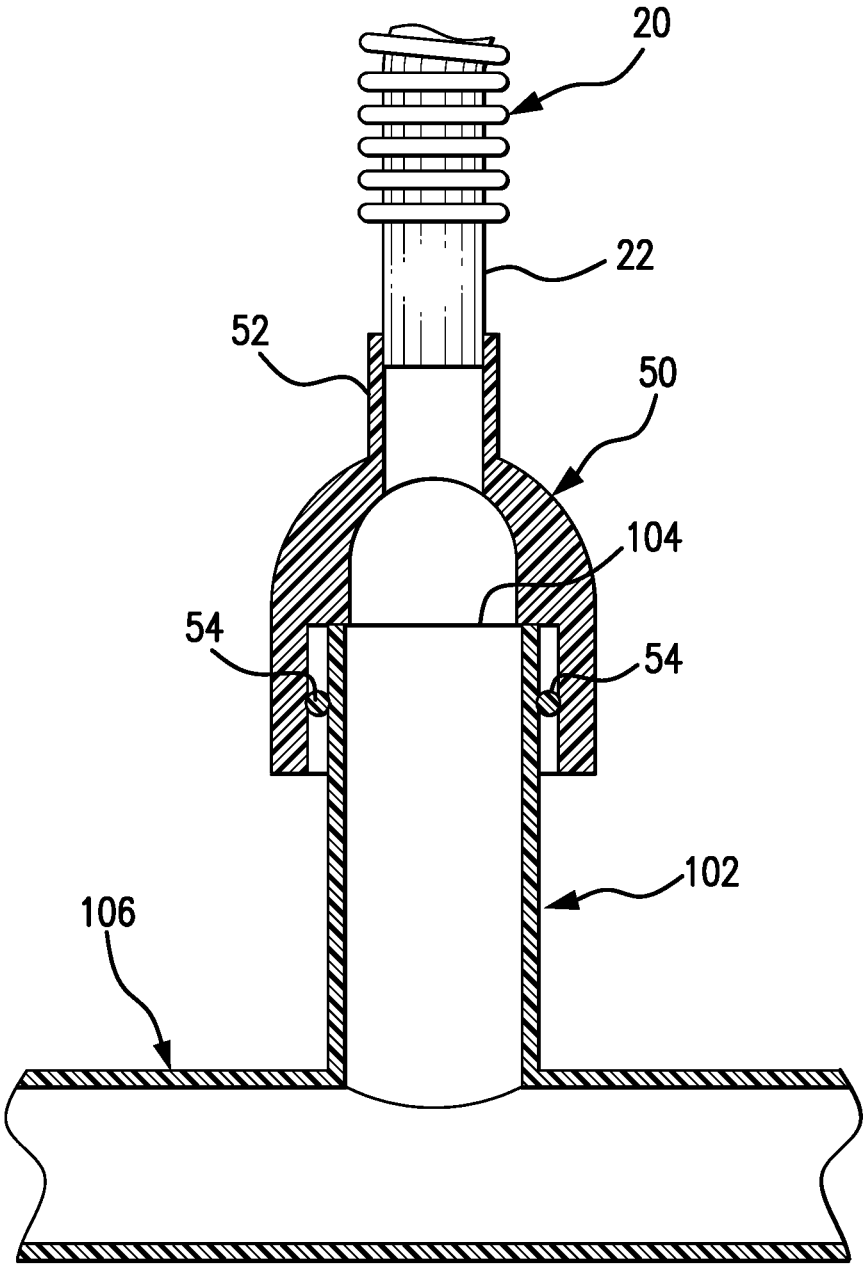
FIG. 5 is a cross-sectional view showing the adapter fitted over the open end of the ¾ inch PVC drain line extension of FIG. 4.

As seen in FIGS. 4-5, the opposite distal end 22 of the flexible hose 20 can be connected to various adapters or fittings to allow for ideal connection to a drain line or toher conduit. For instance, as seen in FIG. 4, an adapter 50 can be connected to the distal end 22 of the flexible hose 20 and fitted over the open end 104 of a PVC drain line extension 102 (e.g., ¾ inch diameter). The adapter 50, sealed around the exterior of the PVC pipe extension 102, allows for application of either a suction force or forced flow to be directed through the drain line 106, upon operation of the bellows pump 12, in order to clear a clog.

While the present invention has been shown and described in accordance with several preferred and practical embodiments thereof which are not limited and departures from the instance disclosure are fully contemplated within the spirit and scope of the present invention.

What is claimed is:

1. A device for clearing a clog comprising:

a foot operated pump including a top plate member, a base plate member, a flexible and collapsible wall attached to and extending between the top plate member and the base plate member, and an interior variable volume chamber surrounded by the top and base plate members and the flexible and collapsible wall, and the top plate member normally disposed in a raised, angled position relative to the base plate member when in a relaxed state, wherein the top plate member is at a furthest separation from the base plate and the interior variable volume chamber has a maximum volume;

an outlet port on the foot operated pump structured and disposed to release a charge of air or liquid contents from within the variable volume chamber upon forced downward movement of the top plate member towards the base plate member causing a reduction of volume of the variable volume chamber;

an inlet port on the foot operated pump structured and disposed to intake air from an exterior of the foot operated pump and into the variable volume chamber upon movement of the top plate member away from the base plate member towards the relaxed state as the volume of the variable volume chamber progressively increases; and a flexible hose having a proximal end structured and disposed for connection to either the outlet port or the inlet port, and a distal end having at least one opening, whereby the released charge of air or liquid contents is forcibly discharged from the at least one opening at the distal end when the proximal end is connected to the outlet port and the top plate member is forced in the downward movement, and further whereby the intake of air from the exterior of the foot operated pump enters through the at least one opening at the distal end when the proximal end is connected to the inlet port and the top plate member moves away from the base plate member towards the relaxed state to create a suction force at the at least one opening at the distal end, through a length of the hose and the inlet port.

2. The device as recited in claim 1 wherein the outlet port includes a one-way check valve member structured and disposed to prevent intake of air or liquid upon movement of the top plate member away from the base plate member.

3. The device as recited in claim 2 wherein the intake valve includes a one-way check valve member structured and disposed to prevent release of the air or liquid contents of the interior variable volume chamber out from the inlet port upon downward movement of the top plate member towards the base plate member.

4. The device as recited in claim 1 wherein the pump includes a drain port and a cap that normally covers and seals the drain port closed and wherein the cap is separable from the drain port to open the drain port and to allow emptying and filling of liquid contents within the interior variable volume chamber.

5. The device as recited in claim 1 wherein the outlet and inlet ports and the proximal end of the flexible hose are cooperatively structured for releasable and interlocking engagement of the proximal end within both the outlet port and the inlet port.

6. The device as recited in claim 5 wherein the proximal end of the flexible hose includes a fitting that is structured and disposed for cooperative, interlocking engagement within both the inlet port and the outlet port.

7. The device as recited in claim 1 wherein at least a portion of a bottom exterior surface of the base plate member includes a slip resistant material that provides a grip on an underlying support surface.

8. The device as recited in claim 1 wherein an exterior bottom surface of the base plate member includes a plurality of rubber feet for gripping engagement with an underlying support surface to discourage slipping or sliding of the base plate member relative to the underlying support surface.

9. The device as recited in claim 1 further comprising:

at least one spring element fitted between the top plate member and the base plate member for urging the top plate member to the relaxed state.

10. The device as recited in claim 1 further comprising:

an adapter structured for removable attachment to the distal end of the flexible hose, and the adapter being structured and disposed for removable fitting to an open end of a conduit, whereby the forcibly discharged air or liquid contents or the suction force is directed into the open end of the conduit for removing a clog.

11. The device as recited in claim 10 wherein the conduit is in fluid communication with a drain line.

12. The device as recited in claim 11 wherein the drain line is a condensate drain line in an HVAC system.

13. The device as recited in claim 12 wherein the adapter is structured and disposed for sealed engagement over the open end of the conduit.

14. A device for clearing a clog comprising:

a foot operated pump including a top plate member, a base plate member, a flexible and collapsible wall attached to and extending between the top plate member and the base plate member, and an interior variable volume chamber surrounded by the top and base plate members and the flexible and collapsible wall, and the top plate member normally disposed in a raised, angled position relative to the base plate member when in a relaxed state, wherein the top plate member is at a furthest separation from the base plate and the interior variable volume chamber has a maximum volume;

an outlet port on the foot operated pump structured and disposed to release a charge of air or liquid contents from within the variable volume chamber upon forced downward movement of the top plate member towards the base plate member causing a reduction of volume of the variable volume chamber;

an inlet port on the foot operated pump structured and disposed to intake air from an exterior of the foot operated pump and into the variable volume chamber upon movement of the top plate member away from the base plate member towards the relaxed state as the volume of the variable volume chamber progressively increases;

a flexible hose having a proximal end structured and disposed for connection to either the outlet port or the inlet port, and a distal end having at least one opening, whereby the released charge of air or liquid contents is forcibly discharged from the at least one opening at the distal end when the proximal end is connected to the outlet port and the top plate member is forced in the downward movement, and further whereby the intake of air from the exterior of the foot operated pump enters through the at least one opening at the distal end when the proximal end is connected to the inlet port and the top plate member moves away from the base plate member towards the relaxed state to create a suction force at the at least one opening at the distal end, through a length of the hose and the inlet port; and the outlet port, the inlet port and the proximal end of the flexible hose are cooperatively structured for selective and releasable, interlocking engagement of the proximal end within either the outlet port or the inlet port.

15. The device as recited in claim 14 wherein the outlet port includes a one-way check valve member structured and disposed to prevent intake of air or liquid upon movement of the top plate member away from the base plate member.

16. The device as recited in claim 15 wherein the intake valve includes a one-way check valve member structured and disposed to prevent release of the air or liquid contents of the interior variable volume chamber out from the inlet port upon downward movement of the top plate member towards the base plate member.

17. The device as recited in claim 14 wherein the pump includes a drain port and a cap that normally covers and seals the drain port closed and wherein the cap is separable from the drain port to open the drain port and to allow emptying and filling of liquid contents within the interior variable volume chamber.

18. The device as recited in claim 14 wherein at least a portion of a bottom exterior surface of the base plate member includes a slip resistant material that provides a grip on an underlying support surface.

19. The device as recited in claim 14 wherein an exterior bottom surface of the base plate member includes a plurality of rubber feet for gripping engagement with an underlying support surface to discourage slipping or sliding of the base plate member relative to the underlying support surface.

20. The device as recited in claim 14 further comprising:

at least one spring element fitted between the top plate member and the base plate member for urging the top plate member to the relaxed state.

* * * * *